US006322113B1

(12) United States Patent
Ayers et al.

(10) Patent No.: US 6,322,113 B1
(45) Date of Patent: Nov. 27, 2001

(54) LATCH APPARATUS

(75) Inventors: Shawn B. Ayers, Rice Lake; Michael W. Kondratuk, Cameron, both of WI (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 09/374,064

(22) Filed: Aug. 13, 1999

(51) Int. Cl.[7] ..... E05B 3/00

(52) U.S. Cl. ..... 292/336.3; 292/223; 292/224; 292/226; 292/DIG. 61

(58) Field of Search ..... 292/336.3, 224, 292/226, DIG. 61, 223

(56) References Cited

U.S. PATENT DOCUMENTS 2,745,691 * 5/1956 Moloney ..... 292/123
2,924,478 * 2/1960 Wartian ..... 292/224
3,677,591 * 7/1972 Waldo ..... 292/221
3,955,839 * 5/1976 Praska ..... 292/226
5,149,154 * 9/1992 Shannan ..... 292/226
5,529,354 * 6/1996 Studt ..... 292/336.3

* cited by examiner

*Primary Examiner*—Gary Estremsky
(74) *Attorney, Agent, or Firm*—Merchant & Gould PC

(57) ABSTRACT

A latch apparatus for a door having a first face and a second face includes a housing adapted for mounting on the first face of the door. The bolt member pivotally mounts to the housing and extends and retracts in and out from the housing and is urged toward an extended position by a return spring. A first push type handle mounts to the housing and retracts the bolt when pushed toward the door. A spindle extends through the door from a second latch pivotally mounted to the second face of the door. The spring back engages the spindle and provides for retracting the bolt upon rotation of the spindle.

22 Claims, 10 Drawing Sheets

LATCH APPARATUS

BACKGROUND OF THE INVENTION

1. Field of the Invention

The present invention is directed to a latch for mounting to an interior face of a door and in particular to a push-type handle with a spring pack module mounted on the interior face of the door.

2. Prior Art

Storm doors and other similar doors are well-known and typically open outward so that pulling on an outer handle is required while the door can be pushed open from the inside. Therefor, a storm door does not normally need to be pulled from the inside. Typical storm door latches have both inside and outside handles rotationally mounted about an axis with a spindle extending through the door. The spindle typically connects both the inside and outside latch on solid cored doors so that they rotate together. Although this configuration does an adequate job of actuating the door bolt, there are problems with such a design. Often, the operator's fingers can be pinched between the handle and the strike plate upon opening, as the handle is rotated toward the door jamb. If a push handle or similar mechanism could be utilized to replace the rotational handle, such pinching may be avoided.

As the there is often an inner door, the exterior of the storm door is typically more readily seen than the inner face of the storm door, its appearance is of greater concern than the inner face of the door. Since a more pleasing exterior is emphasized, the return mechanism for an exterior handle is preferably positioned on the interior of the door. However, such an arrangement may presents design complications with respect to the interior latch handle and its return mechanism.

In addition to mounting design considerations, the packaging of such handle is a consideration for layout and positioning of elements. Former handles typically are packaged by mounting to a backing such as cardboard and then have a shrink wrap applied around the backing and the latch components. Such packaging is easier and more aesthetically pleasing if the latch element is near the backing. Sharp portions extending outward from the backing can more easily pierce the shrink wrap. Moreover, since the packages are often hung off of hooks, it is preferable that the elements be aligned in a narrower linear fashion for more compact presentation at the point of sale. In addition, latches are often part of the original equipment of the door manufacturer. The boxes for doors are typically only slightly thicker than the door. Therefor, the latches should fit in packaging that fits into the door box for shipping. This presents design challenges, as the latch is typically much wider than the thickness of the door box when the latch is installed.

To accommodate linearity for packaging, it is easier if the elements of the latch may be aligned to a linear configuration for shipping and packing and then reconfigured to a use position when assembled. In addition, a modular configuration providing for separation of elements prior to installation to a door, yet providing for self-alignment and assembling with simple tools or without tools, installation may be easily accomplished by the purchaser.

It can seen that a new and improved storm door latch is needed. Such a latch should provide a push-type interior handle that does not create problems for the operator with regarding to fingers being pinched or otherwise hurt. Such a latch should also provide a for mounting of a return mechanism for the outside handle on the interior of the door. In addition, the latch should provide for improved packaging and shipping configurations accommodating shrink wrap type packaging and packaging no thicker than the thickness of a typical door box. The present invention addresses these problems, as well as others associated with storm door latches.

SUMMARY OF THE INVENTION

The present invention is directed to a latch apparatus for storm doors. The latch apparatus includes a pivotal handle mounted to a first side of the door and a push type latching handle on the opposing face of the door. A latch bolt pivotally mounts to the housing and extends and retracts to be received in the door jamb for retaining the door in a locked position. An inner latch mechanism includes a spring pack assembly mounted within the housing receiving a spindle through the door to return the rotatable handle to its at rest position.

The inner latch mechanism includes a housing including an open side receiving a pivotally mounted bolt. A return spring engages the rear face of the bolt to turn it towards its extended position. The push handle includes a lip engaging an underside of the bolt for moving the bolt to a retracted position.

The housing includes a bracket receiving a spring pack that includes a cylindrical hub with flange type camming surfaces extending outward from the hub portion. The hub receives a spindle extending to an exterior handle and rotates with the spindle. The camming surfaces extending from the hub engage inner flange portions at the inside of the rear surface of the bolt so that upon rotation of the spindle, the spring pack is rotated and the bolt is retracted.

The bolt includes an extended lock portion having an angled surface for engaging a corresponding receiver. The bolt pivots on the housing and has rear spring engagement surface with a inner flanges for engaging the spring pack camming surfaces. A lip of the inner push-type handle engages an underside of the upper portion of the bolt to retract the bolt.

The outer handle connects to the spindle, but does not have any return mechanism on its face of the door. A grip rotatably mounts to the escutcheon plate. The outer handle may also include a lock cylinder actuating a dead bolt for additional securement.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a fer part hereof, and to the accompanying descriptive matter, in which there is illustrated and described a preferred embodiment of the invention.

BRIEF DESCRIPTION OF THE DRAWINGS

Referring to the drawings, wherein like reference letters and numerals indicate corresponding structure throughout the several views.

DETAILED DESCRIPTION OF THE PREFERRED EMBODIMENT

Figure 1:
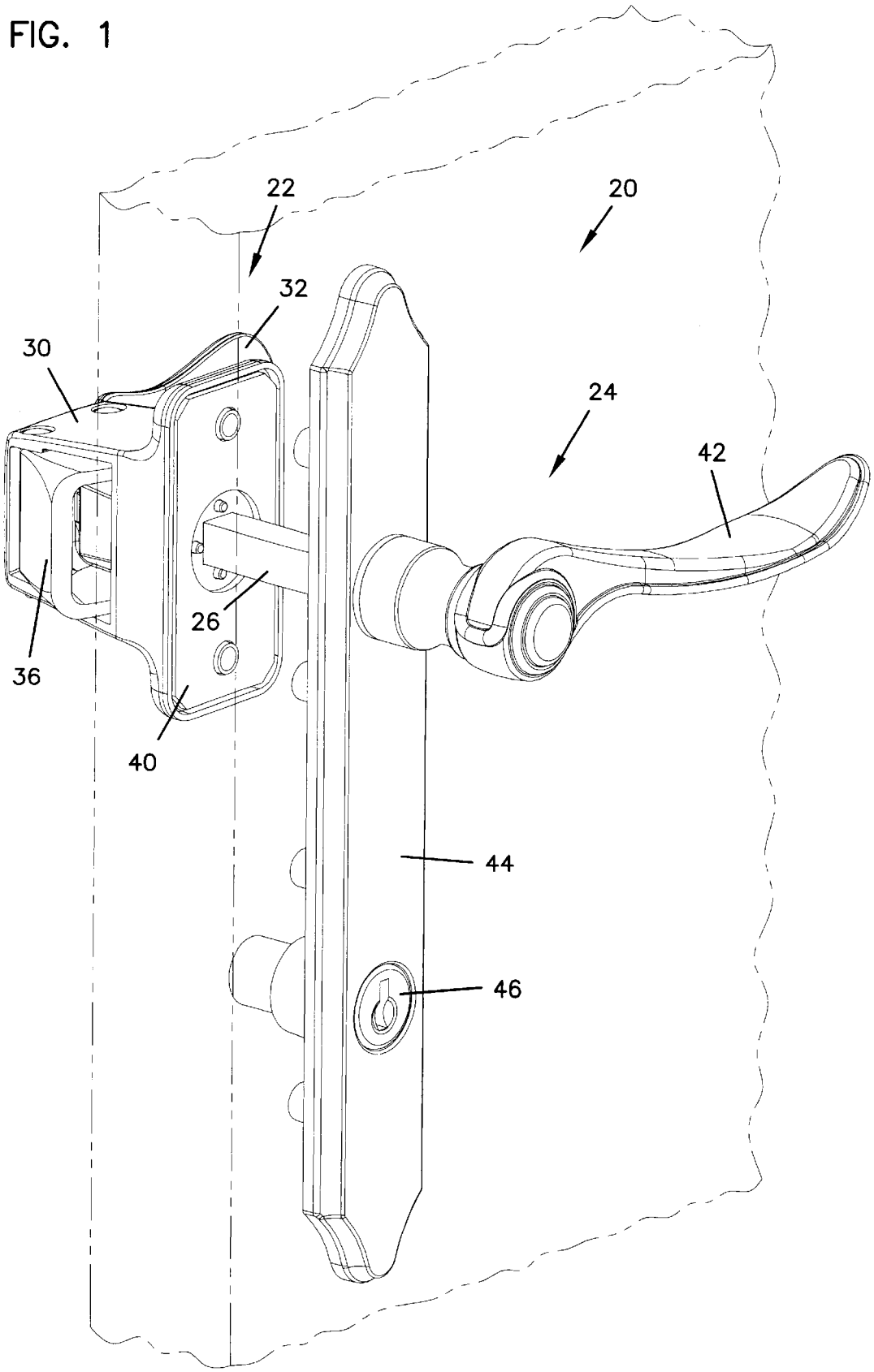
FIG. 1 shows a perspective view of a latch apparatus according to the principles of the present invention.

Referring now to the drawings, and in particular to FIG. 1, there is shown a latch, generally designated 20. The latch 20 has an inner latch mechanism 22 and an outer latch handle 24 for mounting on the inner and outer faces of the door, respectively. The inner latch mechanism 22 and outer latch handle 24 are connected by a spindle 26 that extends through the door. The inner latch mechanism 22 and outer latch handle 24 actuate a bolt 36 of the inner latch mechanism 22 and extends into a receiver in the doorjamb, which often has a strike plate for engaging the bolt 36. The extended bolt 36 in engagement with a receiver in the doorjamb maintains the door in a closed position.

The outer door handle 24 includes a grip portion 42 that receives the spindle 26. The grip portion 42 rotatably mounts to an escutcheon plate 44 that is mounted to the outer surface of the door and may include a key cylinder lock 46 providing for additional retention of the door. The escutcheon 44 of the present invention mounts essentially flat against the outer face of the door and give a very low profile. The present invention provides for both actuation and return positioning of the grip 42 on the interior of the door. This configuration provides for a sleeker more appealing surface on the outside face of the door.

Figure 2:
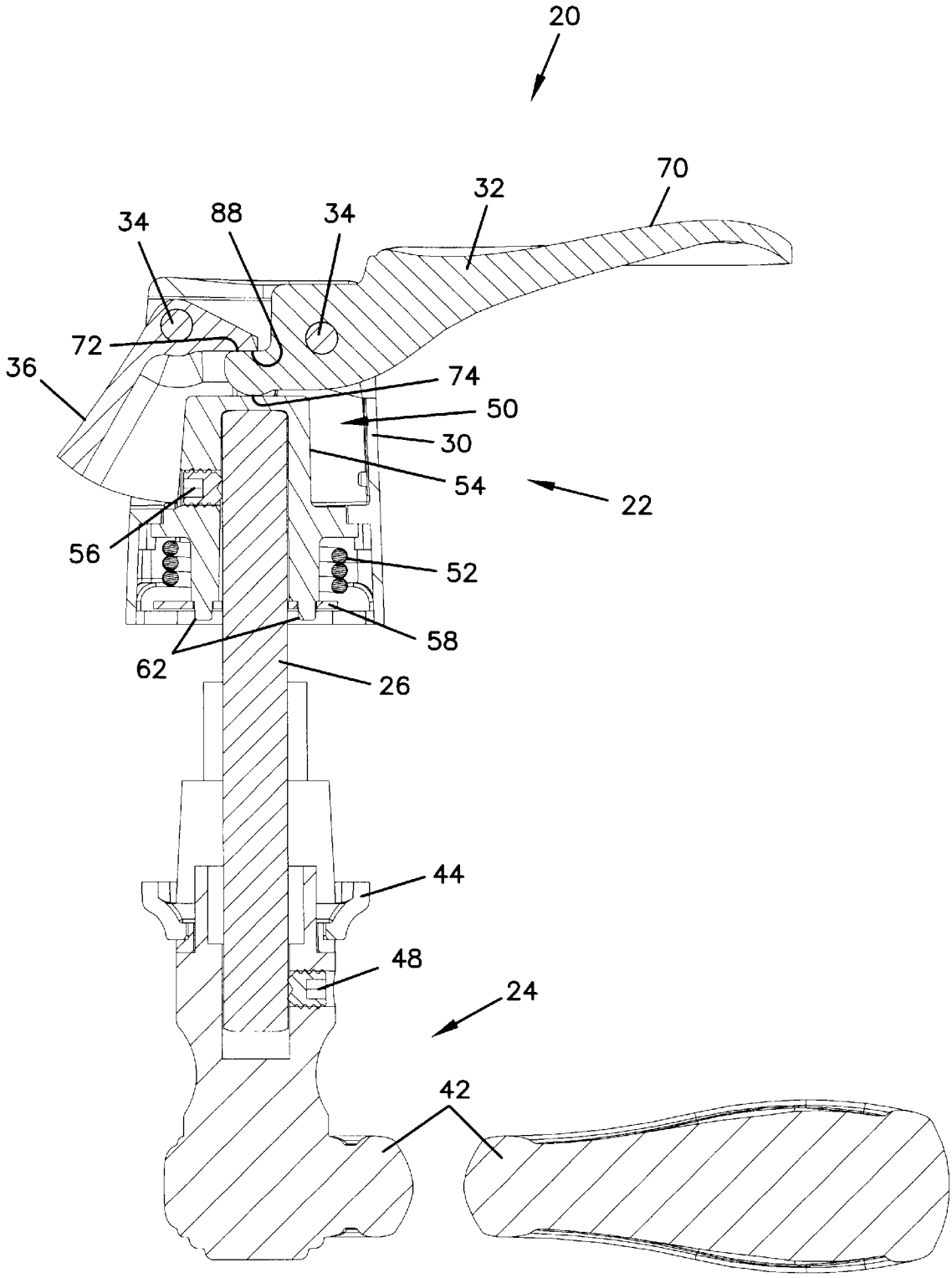
FIG. 2 shows a horizontal sectional view of the latch apparatus shown in FIG. 1.
Figure 3:
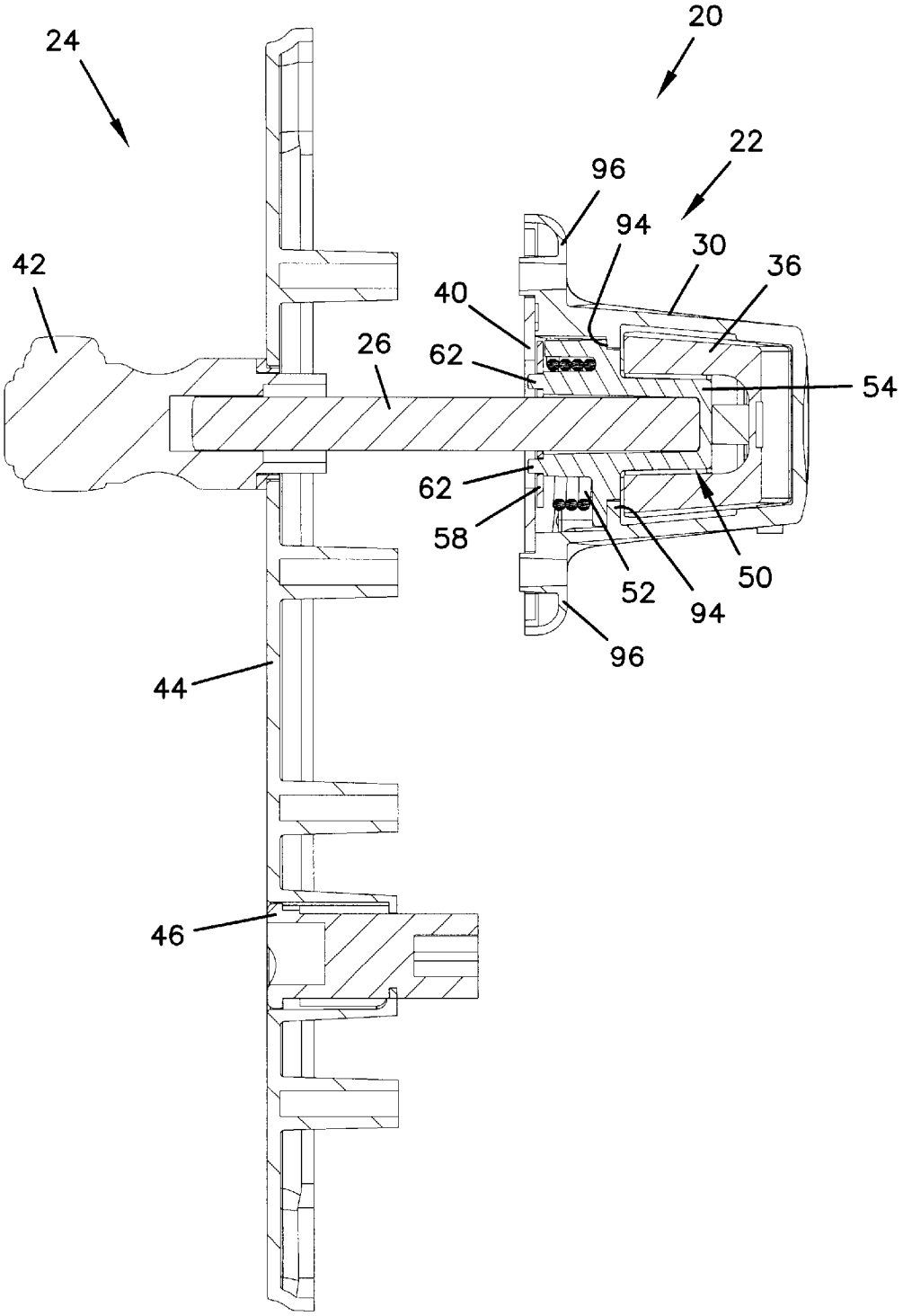
FIG. 3 shows a vertical sectional view of the latch apparatus shown in FIG. 1
Figure 4:
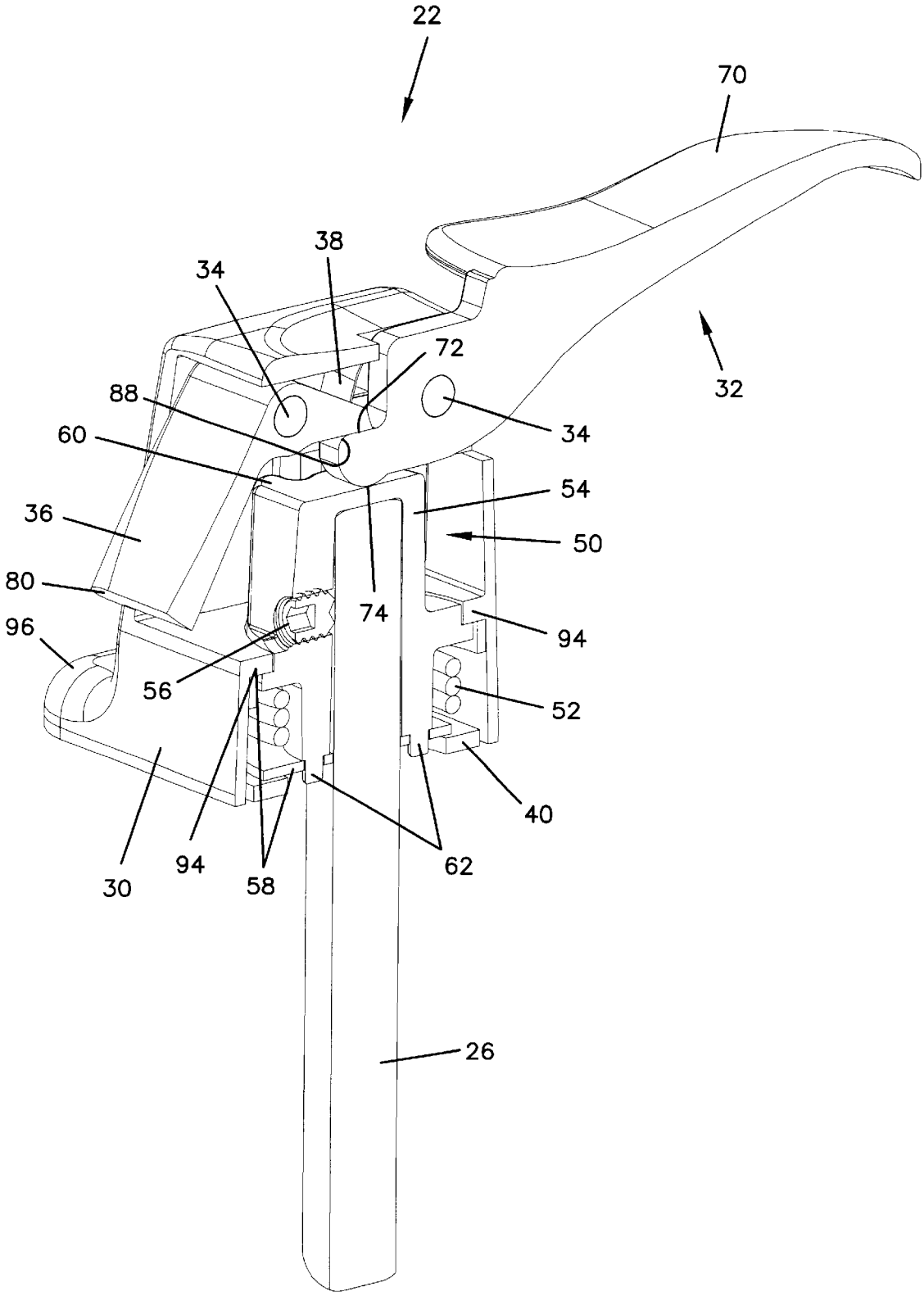
FIG. 4 shows a sectional perspective view of the inner latch mechanism and spindle for the latch apparatus shown in FIG. 1.

Turning now to FIGS. 2 and 3, the latch portion 22 receives the spindle 26 through a substantially rectangular orifice. The outer handle 24 includes a similar rectangular opening that receives the spindle 26. The outer handle 24 connects the spindle 26 by tightening a set screw 48, as shown in FIG. 2. In this manner, as the outer rotatable handle grip 42 turns relative to the escutcheon plate 44, and spindle 26 rotates with the outer handle 24 and actuates the bolt 36 at the inner latch mechanism 22. As shown in FIGS. 2 and 3, a spring pack 50 is positioned within a housing 30 of the inner latch mechanism 22 completely on the inner face of the door.

Figure 5:
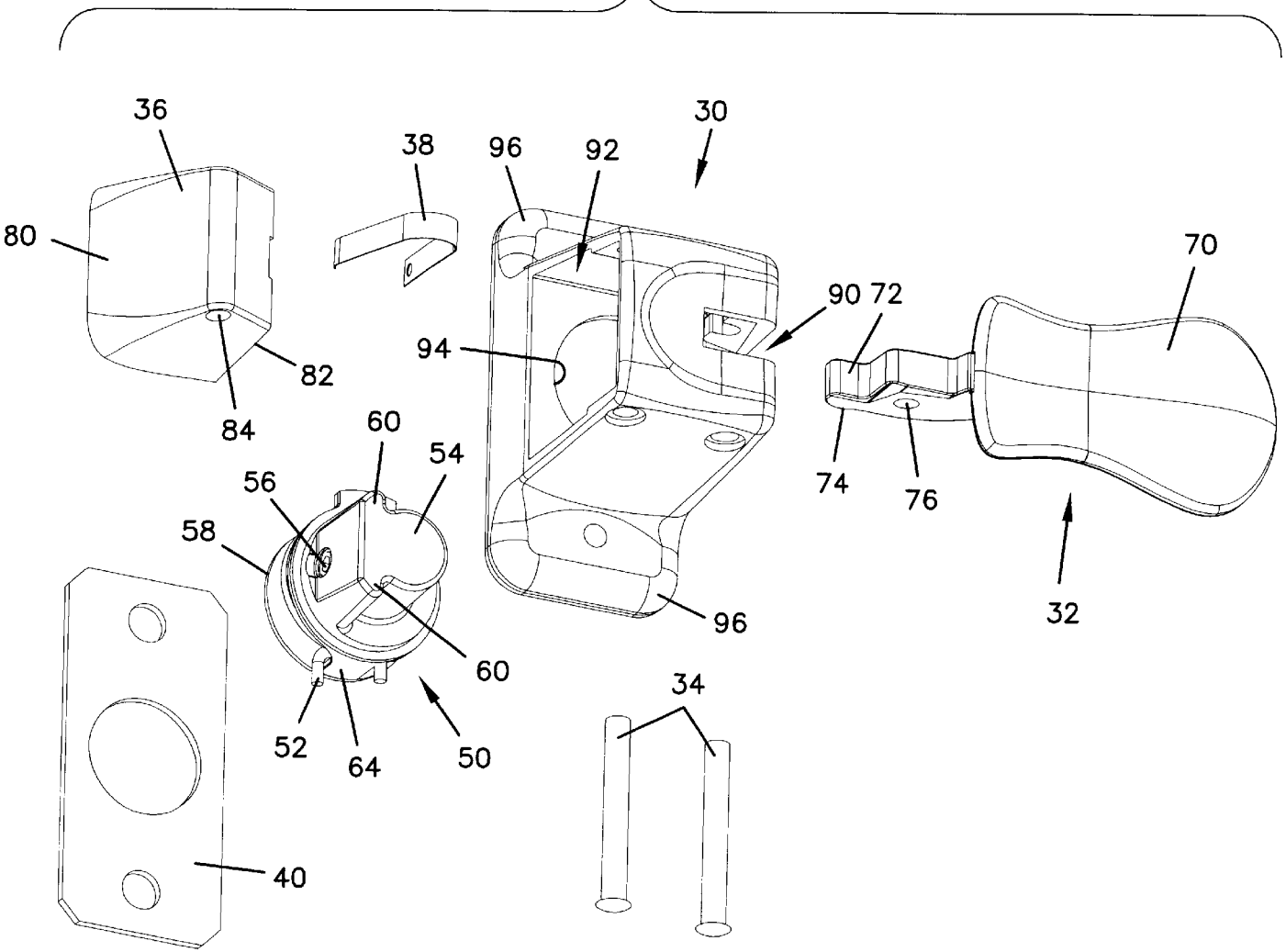
FIG. 5 shows an exploded view of the inner latch mechanism for the latch apparatus shown in FIG. 1.

Turning now to FIG. 5, the inner latch mechanism 22 includes a handle 32 pivotally mounted to the inner latch housing 30. The handle 32 includes a push portion 70 extending from a lip 72 and camming surface 74 for actuating the bolt 36, as explained hereinafter. In addition, the handle 32 is an orifice 76 extending therethrough for mounting on a rivet 34 secured to the housing 30. The housing 30 has a base mounting portion 96 and orifices therethrough for receiving mounting hardware. The housing 30 has an open side 92 from which the bolt 36 extends and retracts. A bracket 94 receives the spring pack 50, and receives and aligns the spring pack 50. The bracket 94 defines a circular opening providing for rotation of the spring pack 50 within the housing 30. A slot 90 opposite the open side 92 receives the handle 32.

The bolt 36 is substantially hollow and includes an extended lock portion 80 which engages a retainer of the door jamb for maintaining the door in a closed position. An orifice 84 extending through the bolt receives one of the rivets 34 for pivotally mounting to the housing 30. A leaf type spring 38 inserts intermediate the housing 30 and the bolt 36 to bias the bolt 36 toward an extended position. A bearing plate 40 is at the base of the housing 30 against the door and retains the spring pack 50 and other components. The bearing plate 40 includes orifices for receiving the mounting hardware in spindle 26.

The bolt's lock portion 80 projects from the housing 30, as shown in FIGS. 4, 7 and 8, 10 and 12, at its extended position. The bolt 36 has a profile that includes an arcing portion extending to an angled edge of the lock portion 80. Spring engagement surfaces 82 on the inner edge of bolt 36 is shown in FIGS. 5, 9, 11 and 12. The bolt 36 is open intermediate the two spring engaging surfaces 82 to receive the spring pack 50, as explained hereinafter. A flange 86, shown most clearly in FIGS. 8,9 and 12, engages the camming portion of the spring pack so that upon rotation of the spindle from an at rest position, the bolt 36 is retracted.

Figure 6:
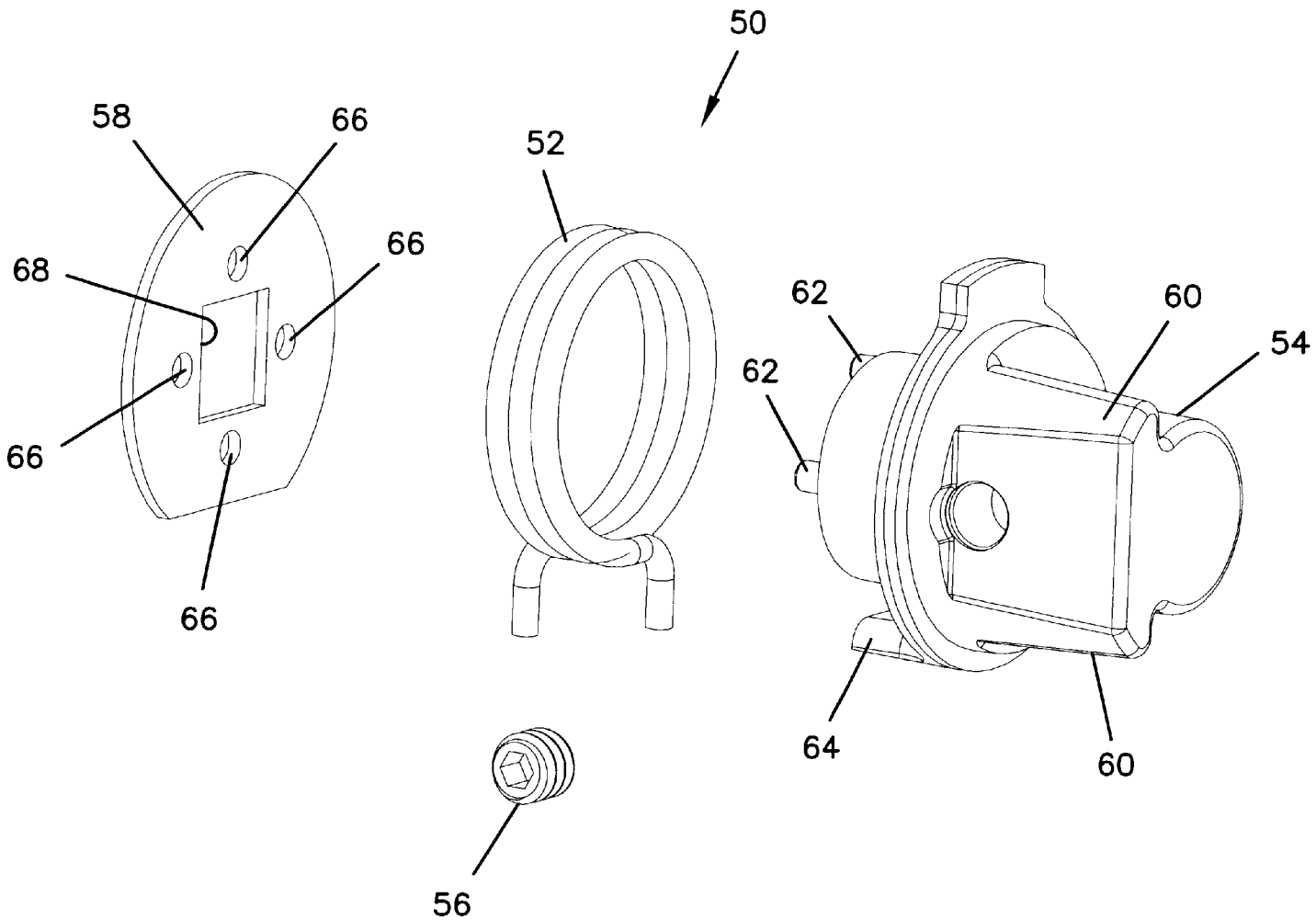
FIG. 6 shows an exploded view of the spring pack for the latch apparatus shown in FIG. 1.

Referring now to FIG. 6, the spring pack 50 includes a hub 54 with the cylindrical upper portion having flange type camming portions 60 extending laterally from one edge of the hub. The bottom of the hub 54 extends toward a bracket with a spring stop 64. A torsion spring 52 slides onto the hub 54 and engages the stop 64. Alignment members 62 project axially from the hub 54 into alignment orifices 66 in a cap 58. The cap 58 also includes a rectangular or square central orifice 60 that receives the spindle 26. A set screw 56 threads into the hub 54 and attaches the spring pack 50 to the spindle 26, as shown most clearly in FIGS. 2 and 4.

The bolt 36 of the present invention can be actuated by either rotation of the outer handle 24 or pushing the inner handle 32 toward the face of the door. In either mode of operation, the return spring 38 engages the inner surface 82 of the bolt 36 to urge it back to its extended position. The return spring 38 also acts as the return for the inner handle 32, as the retraction of the bolt 36 pushes the handle 32 back to its at rest position, shown in FIG. 10. The spring pack 50 includes a torsion spring 52 which returns the outer handle grip 42 back to its at rest position.

Figure 7:
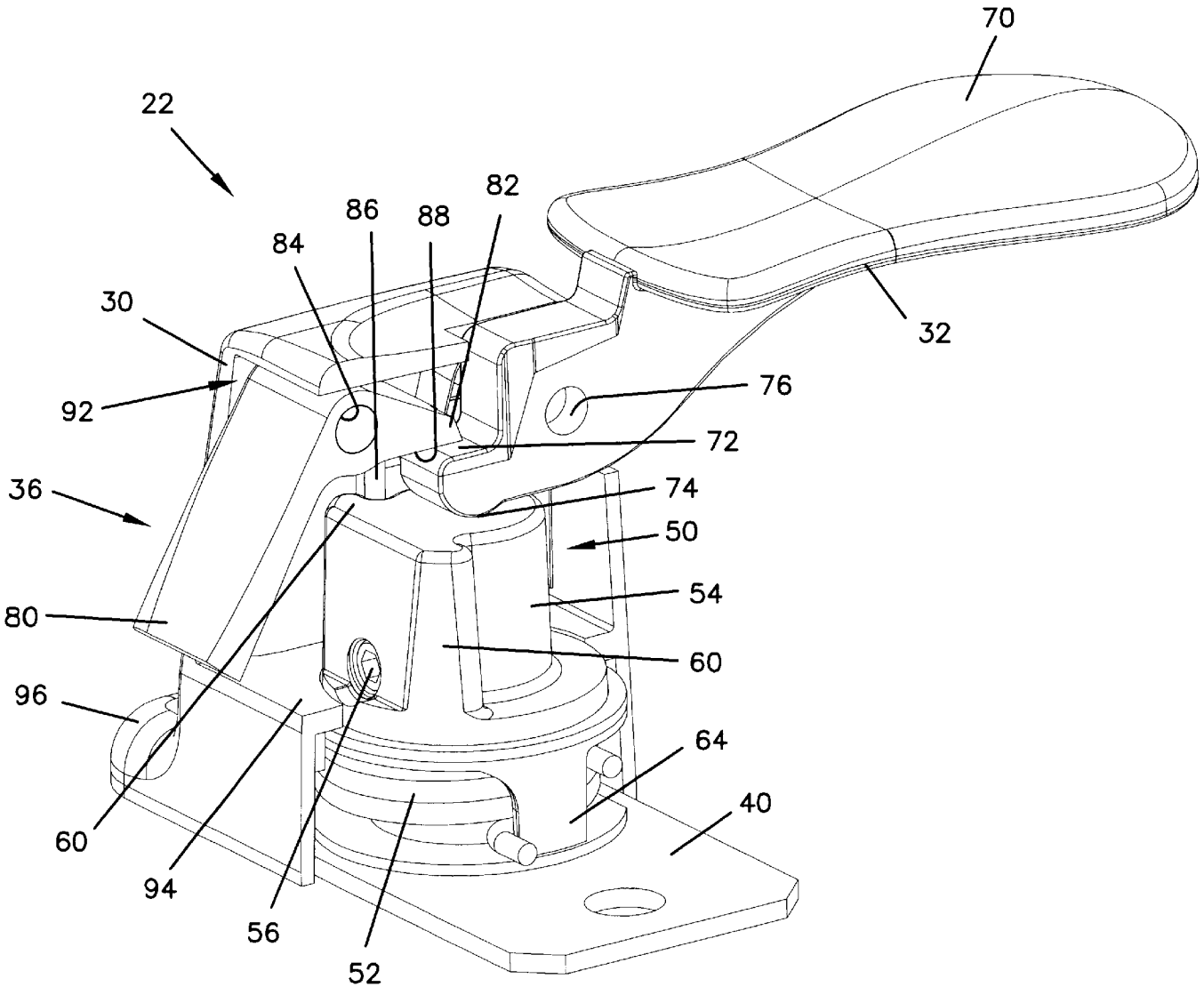
FIG. 7 shows a perspective view with portions removed of the inner latch mechanism for the latch apparatus shown in FIG. 1 with the latch bolt extended.
Figure 8:
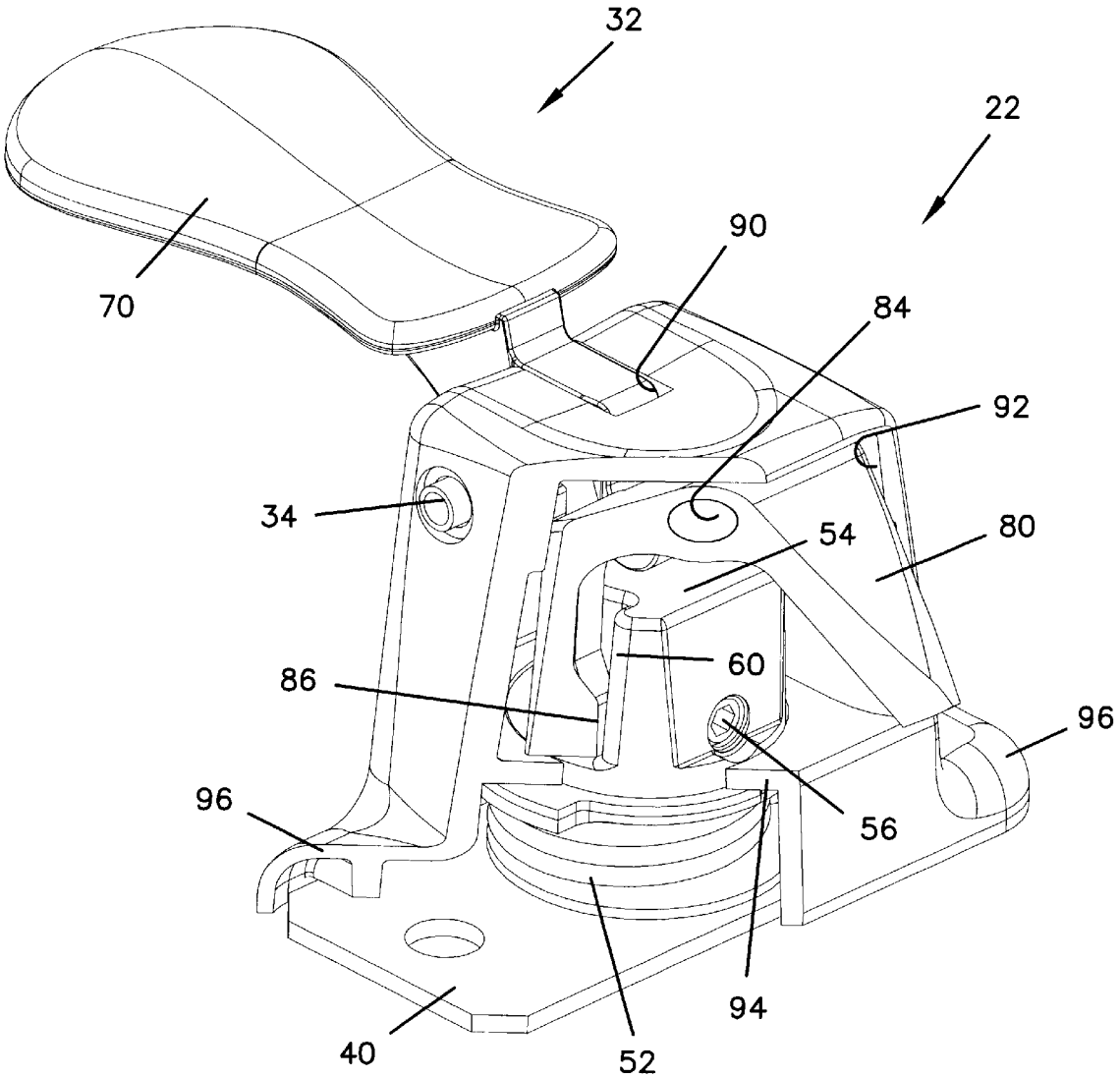
FIG. 8 shows a perspective view with portions removed of the inner latch mechanism for the latch apparatus shown in FIG. 1 with the latch bolt extended and showing engagement of the spring pack with the latch bolt.
Figure 9:
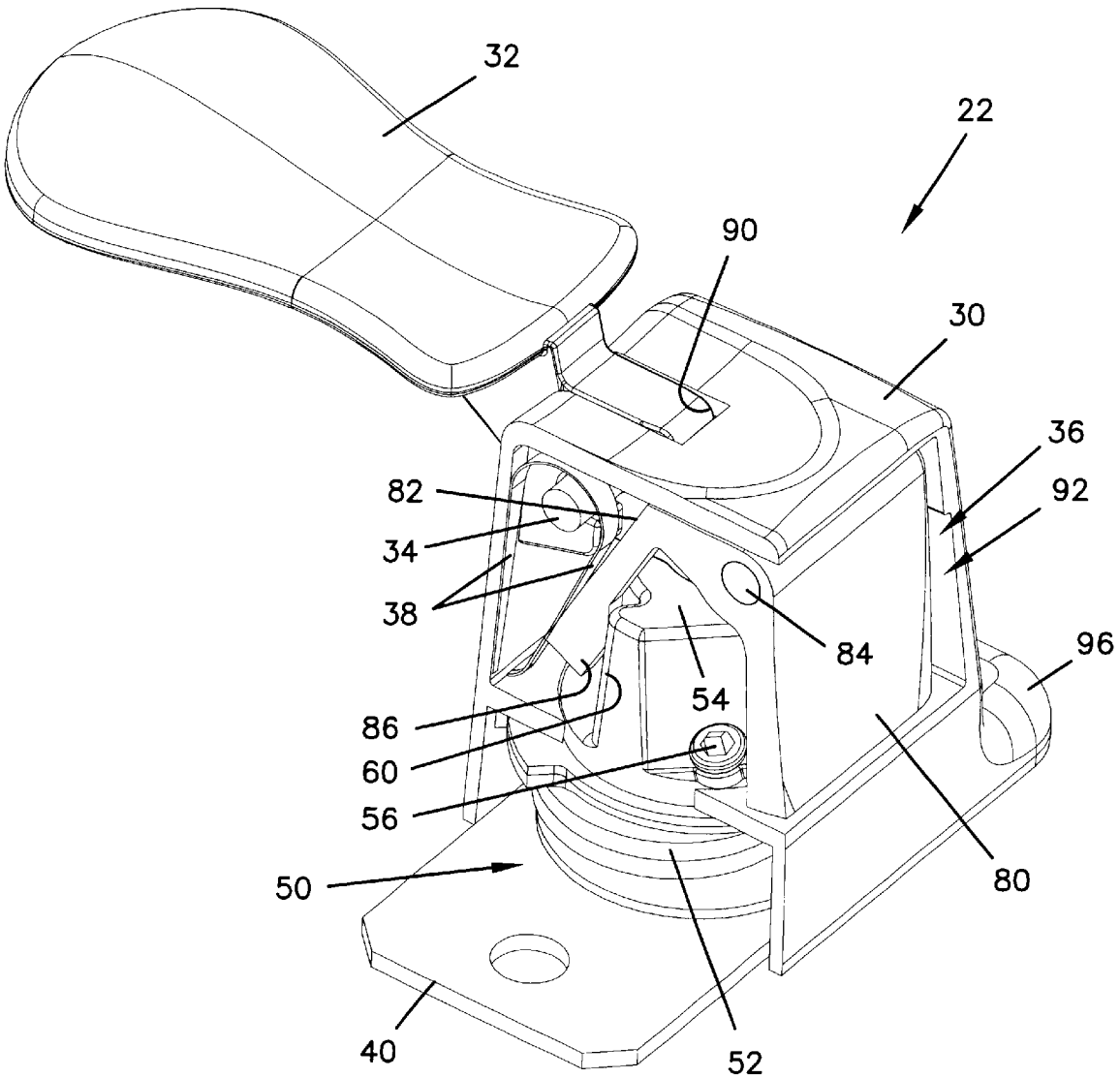
FIG. 9 shows a perspective view with portions removed of the inner latch mechanism for the latch apparatus shown in FIG. 1 with the spring pack rotated and the latch bolt retracted.

Referring to FIGS. 7 through 11, the operation of each of the modes of actuation will be explained. In FIGS. 7 and 8, the bolt 80 is extended beyond the housing 30. A camming portion 60 of the hub 54 abuts the inner flange 86 of the bolt 36. The hub 54 is connected to the spindle 26, so that when the outer handle 24 is rotated, the camming portion 60 of the hub 54 pushes against an associated flange 86 of the bolt 36. This motion retracts the bolt 36, as shown in FIG. 9. In this position, bolt 36 is retracted in the housing 30 from its at rest position. When the end of handle 24 is released, the return spring 38 presses against the inner surface 82 as shown in FIG. 9, pressure from the spring 38 returns the bolt 36 to the position shown in FIGS. 7 and 8. This movement of the bolt 36 also pushes the hub 54 back to its at rest position and the torsion spring helps to realign the outer handle 24 to the non-actuated position.

Figure 10:
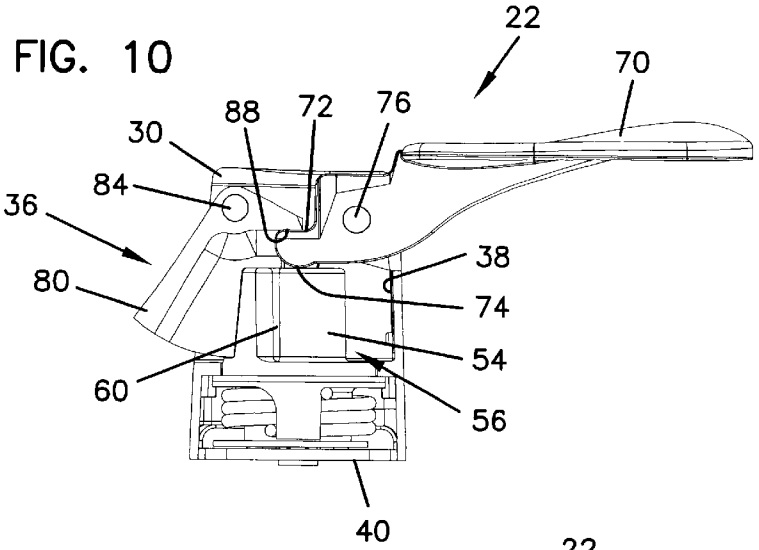
FIG. 10 shows a side view with portions removed of the inner latch mechanism for the latch apparatus shown in FIG. 1 with the latch bolt extended.

Shown in FIGS. 7 and 10 in the at rest position, the push portion 70 extends substantially parallel to the bearing plate 40 and the inner face of the door. Camming surface 74 abuts the top of the hub 54. The lip 72 engages the engagement surface 88 of the bolt 36. The grip portion 70 extends away from the edge of the door so that the operator's fingers and knuckles are not pinched or scraped.

Figure 11:
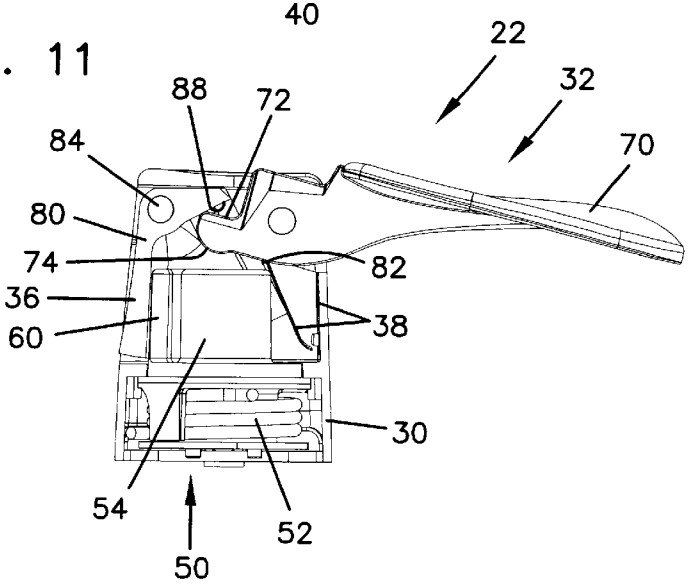
FIG. 11 shows a side view with portions removed of the inner latch mechanism for the latch apparatus shown in FIG. 1 with the push handle actuated and the latch bolt retracted.

To retract the bolt 36, the grip portion 70 is pushed toward the face door, as shown in FIG. 11. Rotation occurs about the axis extending through mounting hole 76. This pivots the lip 72 outward from the hub 54, thereby pushing the door engaging surface 88 of the bolt 36. This motion rotates the bolt 36 about the rivet 34 extending through orifice 84 and causes the bolt 36 to retract to the position shown in FIG. 11. When the push portion 70 is released, the inner spring 38 pushes against the rear surface 82 of the bolt 36 to urge it back to the position shown in FIG. 10. The underside surface 88 of the bolt 36 pushes the lip 72 downward until the cam portion 74 engages the top of the hub 54. This engagement helps to position the handle 32 with the grip portion 70 extending parallel to the door, as shown in FIG. 10.

It will be appreciated that the present invention provides for the return mechanism and actuation of the bolt 36 from both the inner latch mechanism 22 and outer handle 24 on the inner face of the door. Only the spindle 26 extends through the door for a simple mounting and reliable actuation.

Figure 12:
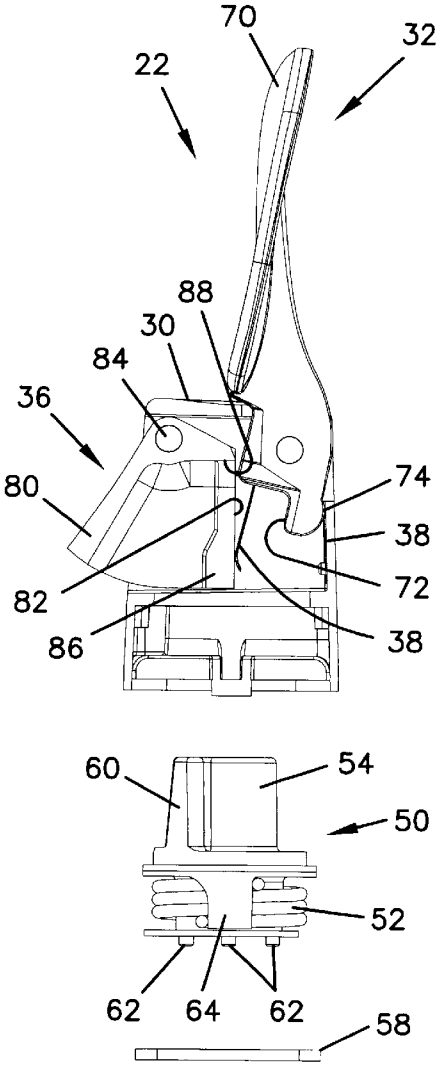
FIG. 12 shows a side view with portions removed of the inner latch mechanism for the latch apparatus shown if FIG. 1 with the spring pack removed and the push handle in a shipping position.

As the spring pack 50 has its own modular assembly, it can be easily inserted by an unskilled person without use of special tools. Therefore, the latch 20 may be better configured prior to installation during shipping and for display at the point of sale. Referring now to FIG. 12, when the spring pack 50 is removed from the housing 30, the grip portion 70 of the handle 32 may be moved to a third position whereat it extends substantially perpendicular to its at rest position shown in FIG. 10. In the position shown in FIG. 12, the grip portion 70 is substantially in alignment with the housing 30 so that the latch 20 may be placed against a flat mounting surface and provide for easier inexpensive packaging, such as shrink wrap. Assembly is easily accomplished as the handle 32 may be pushed to the position shown at FIG. 10 and the spring pack 50 inserted into the bottom of the housing 30. Prior to assembly, the other components such as the spindle 26, outer handle 24 and escutcheon plate 44 may also be placed flat against a backing for more compact packaging.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A latch apparatus for a door, the door having a first face, a second face and an edge, the latch apparatus comprising:

a housing adapted for mounting on the first face of the door;

a bolt member pivotally mounted to the housing and adapted for extending and retracting beyond the edge of the door;

a return spring engaging the bolt member and biasing the bolt member toward an extended position;

a first latch handle pivotally mounted to the housing and engaging the bolt member, wherein the first latch handle is adapted for pivoting toward and away from the first face, and wherein upon pushing the first handle toward the first face of the door, the bolt retracts;

a second latch handle adapted for rotatably mounting to the second face of the door and having a spindle adapted to extend through the door; and a spring pack mounted in the housing and engaging the bolt and the spindle for rotationally positioning the second latch handle.

2. A latch apparatus according to claim 1, wherein the bolt member includes a flange and the spring pack includes a cam portion engaging the flange.

3. A latch apparatus according to claim 1, wherein the housing includes a pivot for the first latch handle.

4. A latch apparatus according to claim 1, wherein the first handle includes a camming surface engaging the bolt member.

5. A latch apparatus according to claim 1, wherein the spring pack includes a torsion spring.

6. A latch apparatus according to claim 5, wherein the spring pack includes a camming member engaging the bolt member.

7. A latch apparatus according to claim 5, wherein rotation of the spring pack retracts the bolt member.

8. A latch apparatus according to claim 1, wherein the spring pack comprises a module adapted for being retained intermediate the first face of the door and the housing.

9. A latch apparatus according to claim 8, wherein the spring pack module comprises a torsion spring having an axis and a camming member axially aligned with the torsion spring.

10. A latch apparatus for mounting to a door having a first face, an edge, and a second face, the latch apparatus comprising;

a housing adapted for mounting on the first face of the door;

a bolt member pivotally mounted to the housing and adapted for extending and retracting beyond the edge of the door;

a first latch handle pivotally mounted to the housing and engaging the bolt member, wherein the first latch handle is adapted for pivoting toward and away from the first face, and wherein upon pushing the first handle toward the first face of the door, the bolt retracts;

a spring pack removably mounted in the housing and engaging the bolt and adapted for receiving a spindle;

wherein the first handle is movable in a limited range between a first position and a second position when the spring pack is inserted in the housing, and wherein the handle is movable to a third position beyond the limited range and substantially transverse to the first position when the spring pack is removed.

11. A latch apparatus according to claim 10, further comprising a return spring biasing the bolt toward an extended position.

12. A latch apparatus according to claim 10, further comprising a second latch handle having the spindle and adapted for rotatably mounting to the second face of the door, wherein the spindle is adapted to extend through the door.

13. A latch system adapted for mounting to a door having a first face, an edge, and a second face, the latch apparatus comprising;

a housing having a mounting plane and adapted for mounting to a first face of the door, a bolt pivotally mounted to the housing and movable between an extended position and a retracted position;

a push handle pivotally mounted to the housing and pivoting between a first position, a second position and a third position;

a spring pack module adapted for being retained intermediate the housing and the first face of the door when assembled, wherein the spring pack module comprises a torsion spring having an axis and a camming member axially aligned with the torsion spring.

14. A latch system according to claim 13, wherein the handle is pivoted to the first position for shipping and wherein the spring pack module is removed from the housing in a shipping configuration.

15. A latch system according to claim 13, wherein the spring pack module comprises a torsion spring having an axis and a camming member axially aligned with the torsion spring.

16. A latch system adapted for mounting to a door having a first face, an edge, and a second face, the latch apparatus comprising;

a housing having a mounting plane and adapted for mounting to a first face of the door;

a bolt pivotally mounted to the housing and movable between an extended position and a retracted position;

a push handle pivotally mounted to the housing and pivoting between a first position, a second position and a third position, wherein at the first position, the handle extends away from the mounting plane, at the third position, the handle extends toward the mounting plane and at the second position the handle is intermediate the first and third positions; and a spring pack module adapted for being retained intermediate the housing and the first face of the door when assembled;

wherein the handle is movable between the first, second and third positions prior to insertion of the spring pack and wherein the handle is restrained between the second and third position when the spring pack is inserted.

17. A latch system according to claim 16 wherein the handle is substantially perpendicular to the mounting plane in the first position.

18. A latch apparatus for a door, the door having an outer face, an inner face and an edge, the latch apparatus comprising:

a housing adapted for mounting to the inner face of the door;

a bolt member pivotally pivotally mounted to the housing and adapted for extending and retracting beyond the edge of the door;

an inner latch handle pivotally mounting to the housing and engaging the bolt member, wherein the inner latch handle is adapted for pivoting toward and away from the inner face, and wherein upon pushing the inner handle toward the inner face of the door, the bolt retracts;

an outer latch handle adapted for rotatably mounting on the outer face of the door and having a spindle adapted to extend through the door; and a spring pack adapted for mounting on the inner face of the door and engaging the spindle for rotationally positioning the outer latch handle and for retracting the bolt member when the outer latch handle is rotated in a first direction.

19. A latch apparatus for a door, the door having a first face, a second face and an edge, the latch apparatus comprising:

a housing adapted for mounting to the first face of the door;

a bolt member pivotally mounted to the housing and adapted for extending and retracting beyond the edge of the door;

a first latch handle adapted for pivotally mounting to the housing and engaging the bolt member, wherein the first latch handle is adapted for pivoting toward and away from the first face, and wherein upon pushing the first handle toward the first face of the door, the bolt retracts;

a second latch handle adapted for rotatably mounting to the second face of the door and having a spindle adapted to extend through the door; and a spring pack adapted for mounting on the first face of the door and engaging the bolt and the spindle for rotationally positioning the second latch handle.

20. A latch apparatus according to claim 19, wherein the spring pack is adapted for mounting on the first face of the door and for retracting the bolt member when the second latch handle is rotated in a first direction.

21. A latch system adapted for mounting to a door having a first face, an edge, and a second face, the latch apparatus comprising;

a housing having a mounting plane and adapted for mounting to a first face of the door;

a bolt pivotally mounted to the housing and movable between an extended position and a retracted position;

a first handle pivotally mounted to the housing and pivoting between a first position and a second position, wherein at the first position, the handle extends away from the mounting plane and at the second position, the handle extends toward the mounting plane;

a second latch handle adapted for rotatably mounting on the outer face of the door and having a spindle adapted to extend through the door; a spring pack module adapted for being retained intermediate the housing and the first face of the door when assembled and engaging the spindle for rotationally positioning the outer latch handle and for retracting the bolt member when the outer latch handle is rotated in a first direction.

22. A latch apparatus according to claim 21, wherein the spring pack module is adapted for mounting on the first face of the door and for retracting the bolt member when the second latch handle is rotated in a first direction.

* * * * *